United States Patent [19]

Schönwald

[11] 4,436,490

[45] Mar. 13, 1984

[54] COMPRESSOR AND LUBRICATING PUMP ASSEMBLY

[75] Inventor: Siegfried Schönwald, Bad Neustadt-Saale, Fed. Rep. of Germany

[73] Assignee: Siemens Aktiengesellschaft, Berlin and Munich, Fed. Rep. of Germany

[21] Appl. No.: 382,685

[22] Filed: May 27, 1982

[30] Foreign Application Priority Data

Jun. 15, 1981 [DE] Fed. Rep. of Germany ..... 3123631

[51] Int. Cl.[3] ..... F04B 39/02

[52] U.S. Cl. ..... 417/372; 184/6.18; 415/90

[58] Field of Search ..... 417/372, 902; 415/88, 415/90; 184/6.18

[56] References Cited

U.S. PATENT DOCUMENTS

| | | | |
|---|---|---|---|
| 2,294,742 | 9/1942 | Fraser | 415/90 X |
| 2,440,593 | 4/1948 | Miller | 417/372 |
| 3,037,457 | 6/1962 | Sternlicht | 415/90 |
| 4,239,448 | 12/1980 | Graf | 415/90 |

FOREIGN PATENT DOCUMENTS

| | | |
|---|---|---|
| 1503408 | 2/1970 | Fed. Rep. of Germany . |
| 2428932 | 12/1975 | Fed. Rep. of Germany . |
| 1566687 | 5/1980 | United Kingdom . |

*Primary Examiner*—Leonard E. Smith

*Attorney, Agent, or Firm*—Kenyon & Kenyon

[57] ABSTRACT

A compressor and its external-rotor drive motor are arranged on a common stationary shaft in a unitary housing. On the end of the stationary shaft which is away from the compressor, a friction pump is mounted for pumping lubricant from a supply in the unit housing into an axial canal drilled in the stationary shaft. The impeller of the friction pump consists of a hollow cylinder which is coupled to the external rotor. The hollow cylinder is received in a pump housing which has an annular space between an inner and an outer housing part into which the hollow cylinder extends, forming an inner and an outer gap. The two gaps are in communication with each other and each contains at least one constriction which forces oil carried by rotation of the hollow cylinder past openings in the inner housing into the axial canal.

6 Claims, 2 Drawing Figures

COMPRESSOR AND LUBRICATING PUMP ASSEMBLY

BACKGROUND OF THE INVENTION

The present invention relates to a unitary compressor assembly, in which a compressor and its external-rotor drive motor are arranged in a housing on the same stationary shaft and in which a friction pump for lubricating the compressor is provided at the end of the stationary shaft away from the compressor. The outlet of the pump leads into a canal drilled in the stationary shaft, and inlet of the pump extends into the lubricant supply at the bottom of the unitary housing. The pump also has a hollow cylinder coupled to the external rotor; the cylinder serves as the pump's impeller.

Such a compressor unit is described in DE NO.-A1-15 03 408, where the friction pump is formed by the bearing sleeve, which is designed as a hollow cylinder; spiral slots are provided in the stationary shaft in the region of the bearing sleeve. While such a friction pump is of very simple design, it can pump only a small amount of oil.

DE NO.-A1-24 28 932 shows a friction pump having a shaft which rotates, as the impeller, in a hollow cylinder. Between the shaft and the hollow cylinder there is a gap in which the medium to be transported is dragged along by the rotating shaft. The gap extends over part of the circumference of the hollow cylinder and is confined on both sides by an interrupter which narrows the gap. The entrance and exit for the medium to be pumped are provided at the beginning and the end of the gap. In order to increase the output, several gaps are provided around the circumference of the hollow cylinder. While the pumped volume can be increased in this manner, the output pressure drops substantially because of the shortening of the length of the individual gaps.

DE NO.-B2-27 10 734 corresponds to British Pat. No. 1,566,687 and describes a compressor unit with a radial piston compressor in which oil is introduced into gaps existing between the pistons and the walls of the piston spaces as well as into the gap existing between the cylinder block and the stationary shaft. For this purpose a relatively large quantity of oil with an adequate pumping pressure is required.

It is an object of the invention to develop a compressor unit of the type described at the outset in which oil necessary for lubricating and sealing the mutually movable parts of the compressor is pumped in sufficient quantity and also with the required pressure.

SUMMARY OF THE INVENTION

According to the invention, the problem stated above is successfully solved by providing a pump housing at the shaft which has an annular space between an inner housing part and an outer housing part. A hollow cylinder extends into the annular space so that an inner and an outer gap are formed between the hollow cylinder and the housing parts of the pump housing. Furthermore, a connection is provided between the inner and the outer gap and at least one constriction which acts as an interrupter is provided at each pump housing on either side of the hollow cylinder. Because a gap is provided on each side of the hollow cylinder, the gap space available is nearly doubled without need to reduce of the gap length and, thereby, the output pressure. In addition, this enlargement of the gap space is achieved without additional mechanical structures.

Advantageously, the hollow cylinder is formed onto the bearing cap of the external rotor. This reduces assembly effort. Due to the fact that several through-holes are provided in the wall of the hollow cylinder, pressure and mass flows of the inner and outer gap can equalize.

Advantages in production result from the fact that the walls of the housing part defining the annular space are cylindrical and that separate interrupter parts are inserted in front of each outlet, each being fastened to a wall of the housing part.

To keep the loss of flow across the axial gap between the rotating cylinder and the stationary housing parts small, several ring-shaped washers are stacked on top of each other in the axial gap between the end face of the hollow cylinder and the pump housing. The stack height of the washers is equal to the minimum width of the axial gap which is given by the manufacturing tolerances. Since the laminar flow resistance of several parallel gap cross sections is larger than that of a single gap having the same overall gap width, the flow loss is greatly reduced. Also, it has been found advantageous to make the washers slightly corrugated. In this case, the washers form a stack of springs, the individual washer spacings of which are about equal, on the average.

DETAILED DESCRIPTION OF THE INVENTION

Figure 1:
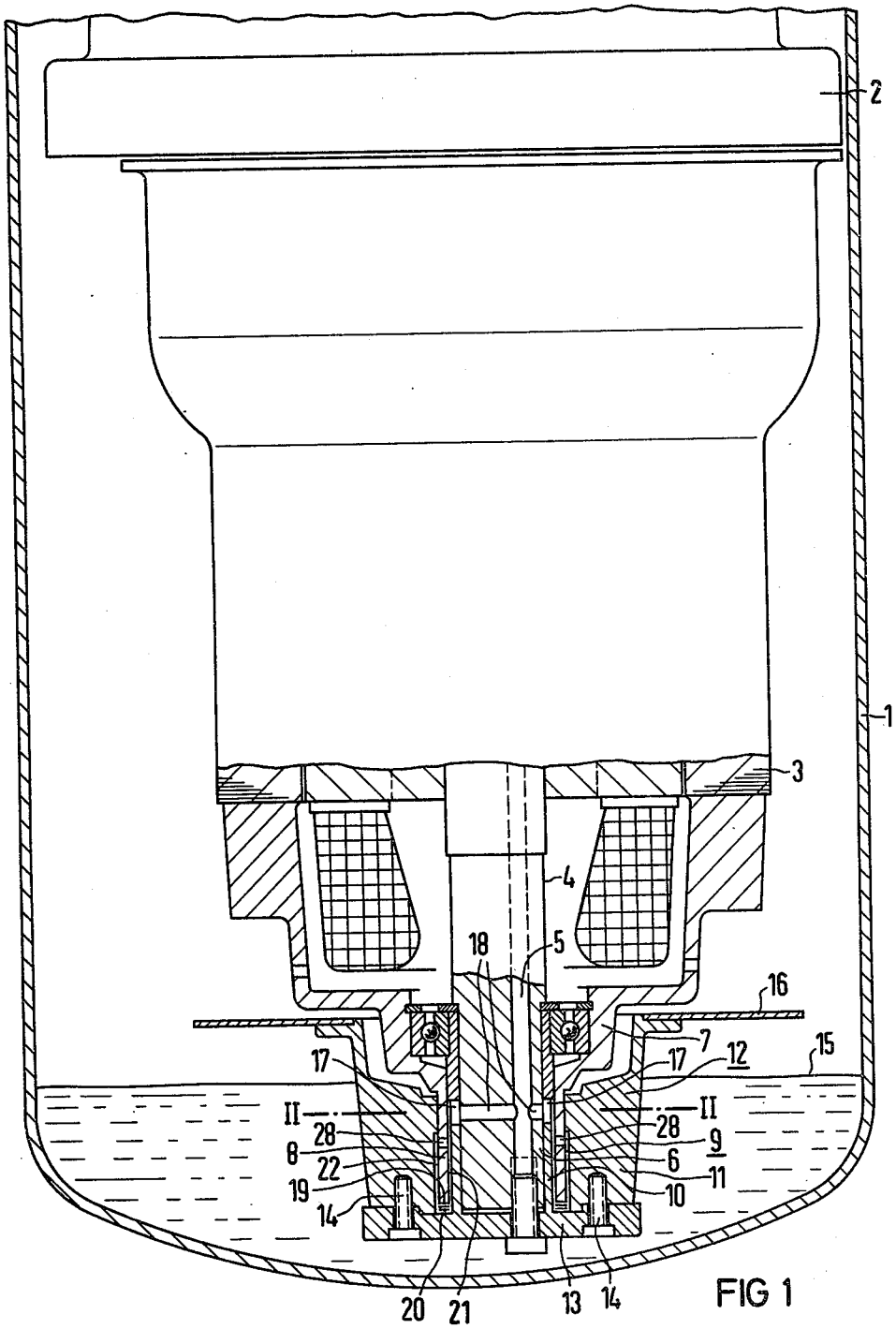
FIG. 1 is a view, in partial cross-section, of a unitary compressor assembly in which a pump is arranged at the end of the stationary shaft which is away from the compressor.

Radial-piston compressor 2 and external-rotor motor 3 are mounted together on a stationary shaft 4 in housing 1. Canal 5, drilled in stationary shaft 4, extends from shaft end 6, which lies away from radial piston compressor 2, towards the compressor 7. Hollow cylinder 8 is formed onto bearing cap 7 of external-rotor motor 3 and constitutes the rotor of a friction pump. Hollow cylinder 8 extends into the annular space 9 which is formed between inner and outer housing parts 10 and 11, respectively, of pump housing 12. Inner housing part 10 consists of a cylindrical wall which is formed on housing end plate 13 and is pushed over end 6 of stationary shaft 4. Housing end plate 13 is connected to outer housing part 11 by means of screws 14. A splash plate 16, the diameter of which is at least equal to the diameter of the external rotor of external-rotor motor 3, is fastened to outer housing part 11 above oil level 15.

The ring wall which forms inner housing part 10 has radial passage openings 17 which coincide with transverse bore hole 18. Bore hole 18 opens into drilled canal 5 in shaft 4. Passage openings 17 constitute outlets of the pump.

Several washers 20 are inserted on top of one another in the axial gap between end face 19 of hollow cylinder 8 and housing end plate 13. The overall width of the axial gap is subdivided by these washers 20 into several parallel gaps of smaller width. The smaller gaps offer more resistance to fluid flow, so that loss through the axial gap is greatly reduced. The washers may be slightly corrugated. In addition, the overall height of stacked washers 20 is made so that it corresponds to the minimum height of the axial gap due to tolerances. Thus, the same number of washers is always inserted in the axial gap, regardless of the actual height of the axial gap.

Figure 2:
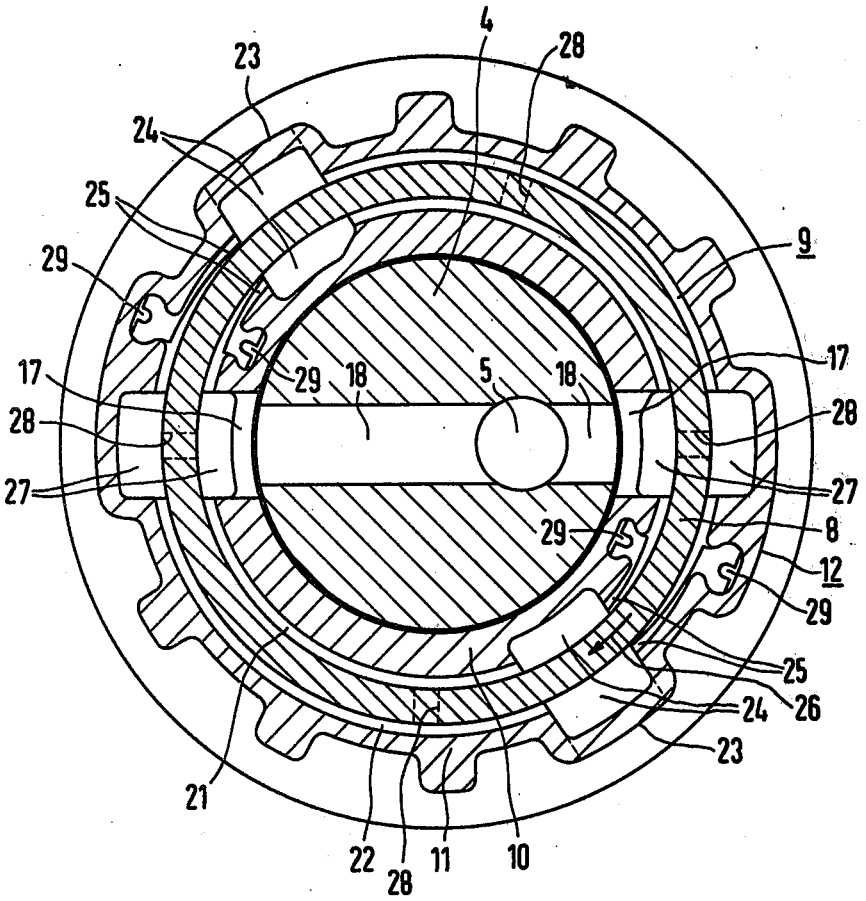
FIG. 2 is a view cross-section along line II—II of the compressor unit of FIG. 1.

The view according to FIG. 2 shows that there are an inner gap 21 and an outer gap 22 between hollow cylinder 8 and inner and outer housing parts 10 and 11, respectively. The oil flows into these gaps via at least one radial inlet canals 23 which is formed in the pump housing 12. Each canal 23 extends under hollow cylinder 8 so that oil from the canal flows into a connecting canal 24 which extends on both the inside and the outside of hollow cylinder 8. Two such axial canals 24 are shown, one on either side of the pump. Oil from canals 24 is dragged along into inner and outer gaps 21 and 22 by the surface of hollow cylinder 8 as it rotates. On each side of the pump and on each side of the wall of hollow cylinder 8 an interrupter 25 is placed which narrows each of the gaps 21 and 22. Oil taken along by hollow cylinder 8 is backed up behind each constriction and is pushed through the associated passage 17 and, via bore hole 18 into canal 5. It then travels to radial-piston compressor 2. Axially extending discharge canals 27, each of which communicates with an exit opening 17, are formed in inner and outer housing parts 10 and 12, respectively, on either side of impeller 8. Along with their associated openings 17, each discharge canal is located in front of an interrupter, ("in front of" relates to the direction of rotation of hollow cylinder 8 as indicated by arrow 26). Connection of the part of canal 27 which lies in outer housing part 11 to the part of canal 27 which lies in inner housing part 10 and into which exit opening 17 opens directly is accomplished via a channel in the pump housing which lies beneath hollow cylinder 8 (not shown). Through-holes 28 are provided in hollow cylinder 8 via which the pressure and the volume of flow between inner and outer gap 21 and 22 can be further equalized.

The sides of inner and outer housing parts 10 and 11 associated with hollow cylinder 8 are made cylindrical so that these housing parts can be manufactured easily. Interrupters 25 are made as separate parts which are inserted into conforming recesses 29 in housing parts 10 and 11 and can fit loosely in the recesses. Other ways of fastening interrupters 25 into housing parts 10 and 11 are, of course, possible. In operation lubricating film is formed between interrupters 25 and hollow cylinder 8 which ensures a small spacing, so that no sliding wear occurs in operation.

As shown in FIG. 2, two interrupters 25 are placed in the outer and inner walls of housing parts 10 and 11. It will be understood that it is also possible to use only one interrupter or to use more than two interrupters so long as the number of radial inlet canals 23, outlet canals 24, and passage openings 17 is made to correspond to the number of interrupters.

In operation, gas in compressor housing 1 is set in rotation by the external rotor of external-rotor motor 3. This rotation produces a centrifugal pressure field which urges the oil at the bottom of compressor housing 1 inward. To prevent seizure and setting of the oil in violent motion by the rotating external rotor, whereby the oil would be mixed with gas bubbles, radial defector plate 16 is provided at the pump housing 12 to direct the oil away from the rotating external rotor.

It should also be mentioned that oil pumped by the friction pump into bore hole canal 5 is conducted via the bore hole canal to the compressor and can also be directed to the bearing points of the drive motor. For this purpose, canals may be branched off from the bore hole canal at appropriate points to lead the oil to the desired locations.

What is claimed is:

1. A unitary compressor assembly comprising:

a compressor with an external-rotor drive motor, both mounted on a stationary shaft which has a bore shaft canal for supplying lubricant to the compressor, a friction pump located at the opposite end of the stationary shaft from the compressor, and a unitary housing;

the friction pump further comprising:

an impeller comprising a hollow cylinder, the cylinder coupled to the external rotor of the drive motor;

a pump housing mounted on the shaft, the pump housing comprising inner and outer parts providing an annular space in which the hollow cylinder is received, the cylinder dividing the annular space into an inner gap and an outer gap;

an outlet coupling the annular space to the borehole;

an inlet coupling the annular space to a supply of oil in the bottom of the unitary housing; and at least one constriction in each gap for impeding the flow of oil.

2. A compressor assembly in accordance with claim 1, and further comprising:

a bearing on the shaft, the bearing having a cap on which the external rotor and the hollow cylinder are supported.

3. A compressor assembly in accordance with claim 1 and further comprising:

at least one through hole in the wall of the hollow cylinder for equalizing pressure and volume of flow between the inner gap and the outer gap.

4. A compressor assembly in accordance with claim 1 in which:

the inner and outer housing parts each have a cylindrical wall which together define the annular space;

the pump outlet comprises at least one radial opening in the inner wall; and each constriction comprises an interrupter fastened to the associated housing wall and located in front of the outlet, away from the direction in which oil is being carried by the impeller.

5. A compressor assembly in accordance with claim 1 in which the hollow cylinder has an end face and there is an axial gap between the end face and the pump housing, and further comprising:

at least two washers, stacked on top of each other and having a stack height equal to the minimum width of the axial gap due to tolerances.

6. The compressor assembly of claim 5 in which the washers are slightly corrugated.

* * * * *